US010677250B2

(12) United States Patent
Seccareccia

(10) Patent No.: US 10,677,250 B2
(45) Date of Patent: Jun. 9, 2020

(54) CENTRIFUGAL CEILING FAN

(71) Applicant: SECTAR SOLUTIONS INC., Montreal (CA)

(72) Inventor: Alessandro Seccareccia, Montreal (CA)

(73) Assignee: SECTAR SOLUTIONS INC., Montréal (CA)

( * ) Notice: Subject to any disclaimer, the term of this patent is extended or adjusted under 35 U.S.C. 154(b) by 298 days.

(21) Appl. No.: 15/502,738

(22) PCT Filed: Aug. 11, 2015

(86) PCT No.: PCT/CA2015/050757
§ 371 (c)(1),
(2) Date: Feb. 8, 2017

(87) PCT Pub. No.: WO2016/023117
PCT Pub. Date: Feb. 18, 2016

(65) Prior Publication Data

US 2017/0234319 A1 Aug. 17, 2017

Related U.S. Application Data

(60) Provisional application No. 62/036,689, filed on Aug. 13, 2014.

(51) Int. Cl.
*F04D 25/08* (2006.01)
*F04D 17/16* (2006.01)
(Continued)

(52) U.S. Cl.
CPC ..... *F04D 25/088* (2013.01); *F04D 17/16* (2013.01); *F04D 19/002* (2013.01);
(Continued)

(58) Field of Classification Search
CPC ..... F04D 25/088; F04D 25/10; F04D 29/582; F04D 29/4226; F04D 29/541; F04D 17/16
See application file for complete search history.

(56) References Cited

U.S. PATENT DOCUMENTS 4,342,258 A 8/1982 Zaniewski
5,668,920 A * 9/1997 Pelonis ..... F04D 25/088 392/361

(Continued)

FOREIGN PATENT DOCUMENTS

WO 2011054093 A1 5/2011

*Primary Examiner* — Woody A Lee, Jr.
(74) *Attorney, Agent, or Firm* — Ibrahim Tamer

(57) ABSTRACT

A centrifugal ceiling fan adapted to evenly ventilate and heat its surrounding area. The fan comprises a casing defining a top, a side, and a bottom. The air inlet is provided in the top and the air outlet comprises a first passage provided in the side and a second passage provided in the bottom, and a central dome for regulating the flow of air between the first passage and the second passage to a desired proportion. The fan comprises a centrifugal propeller having blades which are curved and have a variable width such that rotation of the centrifugal propeller causes air to be received from said air inlet and to be pushed from said air outlet in substantially all directions between the first direction and the second direction. The dome comprises a heat source for heating air pushed downward from the bottom. Whereby, unheated air is pushed sideways and heated air is pushed downward and for evenly ventilating and heating a room in which the centrifugal ceiling fan is installed.

21 Claims, 9 Drawing Sheets

(51) Int. Cl.

| | |
|---|---|
| ***F24F 7/007*** | (2006.01) |
| ***F04D 29/54*** | (2006.01) |
| ***F04D 19/00*** | (2006.01) |
| ***F24F 1/0071*** | (2019.01) |
| ***F04D 29/42*** | (2006.01) |
| ***F04D 29/58*** | (2006.01) |
| *F24F 3/16* | (2006.01) |

(52) U.S. Cl.
CPC ..... *F04D 29/4226* (2013.01); *F04D 29/541* (2013.01); *F04D 29/582* (2013.01); *F24F 1/0071* (2019.02); *F24F 7/007* (2013.01); *F24F 2003/1642* (2013.01)

(56) References Cited

U.S. PATENT DOCUMENTS 6,240,247 B1 * 5/2001 Reiker ..... F04D 25/088 392/364
6,582,192 B2 * 6/2003 Tseng ..... F04D 19/002 415/211.1
6,632,132 B1 10/2003 Kikuchi et al.
6,751,406 B2 * 6/2004 Reiker ..... F04D 25/088 392/364
7,210,910 B1 * 5/2007 Parker ..... F04D 25/088 416/223 R
8,087,878 B2 * 1/2012 Chen ..... F04D 25/088 415/187
9,022,731 B2 * 5/2015 Seccareccia ..... F04D 17/16 415/206
2011/0223007 A1 9/2011 Hammel et al.
2012/0219440 A1 * 8/2012 Seccareccia ..... F04D 17/16 417/423.14
2012/0325442 A1 12/2012 Ikeda et al.
2013/0028759 A1 1/2013 Berroth
2013/0189082 A1 7/2013 Kan
2013/0251521 A1 * 9/2013 Kan ..... F04D 17/025 415/211.2
2016/0319836 A1 * 11/2016 Widell ..... F04D 29/36

* cited by examiner

CENTRIFUGAL CEILING FAN

RELATED APPLICATIONS

The present application claims priority from U.S. Provisional Application No. 62/036,689 filed on Aug. 13, 2014, which is incorporated herein by reference in its entirety.

BACKGROUND (a) Field

The subject matter disclosed generally relates to ceiling fans.

(b) Related Prior Art

FIG. 1 illustrates a conventional axial ceiling fan 20. The ceiling fan 20 includes a plurality of paddles 22, a lamp 24, a motor 26 for turning the paddles 22, and attachment means 28 for attaching the ceiling fan 20 to the roof.

This type of fans has several problems. One of the problems is the uneven distribution of air throughout the room. The paddles are mounted vertically to the axis of rotation and push the air downward in the same direction as the axis of rotation. Therefore, the area outside the radius of the paddles remains unventilated. Other problems associated with axial fans include the space occupied by the paddles and the safety concerns due to the fact that the paddles are exposed as they rotate.

Several attempts have been made to address this problem. For example U.S. Patent Publication No. 2007/0247854 describes a ceiling fan in which the paddles are covered by a casing as shown in FIG. 2. The solution described in this reference addresses only the safety concern. However, the space occupied is substantially the same or even greater than that of FIG. 1, and the lack of even distribution of air remains the same.

One way for reducing the size of the fan, is to make the paddles shorter. Thus, to obtain the same ventilation results, the rotation speed has to be increased, which results in an increase in energy consumption and noise.

Other attempts to address these problems are described in U.S. Pat. Nos. 1,699,201; 4,473,000; 4,768,424, 7,381,129 etc. These references address one problem on the expense of the other.

Therefore, there is a need for a ventilation system which is efficient, safe to use, quiet, and provides even distribution of air throughout the room especially when the air is heated.

SUMMARY

In one aspect, there is provided a centrifugal ceiling fan comprising a casing defining a top, a side and a bottom; an air inlet provided at the top of the casing; a centrifugal propeller configured to rotate about a rotation axis; a motor operatively connected to said centrifugal propeller; an air outlet comprising a first passage for pushing air from the side, and a second passage for pushing air from the bottom; the air outlet comprising a central dome, the central dome coil being adapted to distribute a flow of air between the first passage and the second passage to a desired proportion; wherein rotation of the centrifugal propeller causes air to be received from said air inlet and to be pushed from said air outlet in substantially all directions between the first direction and the second direction for evenly ventilating a room in which the centrifugal ceiling fan is installed.

In an embodiment, the central dome comprises a plurality of openings which are shaped to direct the flow of air pushed downward to desired directions, and dimensioned to regulate an amount of air flow pushed downward to the desired proportion.

In another embodiment, the propeller comprises a plurality of blades provided about the rotation axis, the blades being curved along three dimensions and have a width that varies along the rotation axis to define a space between inner sides of the blades.

The central dome may be provided under the propeller and at least partially received within the space defined by the inner side of the blades.

In an embodiment, the central dome comprises a heating element for heating air pushed downward.

The fan may include an air regulator for regulating the flow of air exiting the fan from the side. An air filter may be provided at the air inlet. A light source may be provided on the side and/or bottom of the fan and may be directed toward a desired area.

In another aspect, there is provided a centrifugal ceiling fan comprising: a casing defining a top, a side and a bottom; an air inlet provided at the top of the casing; a centrifugal propeller comprising a plurality of blades provided about the rotation axis and defining a space between inner sides of the blades; a motor operatively connected to said centrifugal propeller; an air outlet comprising:

- a first passage for pushing air from the side, and
- a second passage for pushing air downward from the bottom;
- a central dome for regulating air flow between the first passage and the second passage to a desired proportion, the central dome defining a volume and being provided underneath the propeller and partially within the space defined by the inner side of the blades; and
- a coil provided within the volume to heat the air pushed downward from the bottom;

wherein rotation of the centrifugal propeller causes air to be received from said air inlet and to be pushed from said air outlet in substantially all directions between the first direction and the second direction, wherein heated air is pushed downward from the bottom and unheated air is pushed sideways for evenly ventilating and heating a room in which the centrifugal ceiling fan is installed.

The central dome may comprise a plurality of openings which are shaped to direct the flow of air pushed downward to desired directions, and dimensioned to regulate an amount of air flow pushed downward to the desired proportion.

In an embodiment, the blades may be curved along three dimensions and have a width that varies along the rotation axis.

An air regulator may be provided for regulating the flow of air exiting the fan from the side.

The fan may further comprise a wireless receiver for receiving operation commands from a remote control for controlling operation of the fan.

In a non-limiting example, the top has a shape of an inversed-bowl, the side has the shape of a trapezoid, and the bottom defines a flat surface.

In another aspect, there is provided a centrifugal ceiling fan comprising: a casing defining a top, a side and a bottom; an air inlet provided at the top of the casing; a centrifugal propeller comprising a plurality of blades provided about the rotation axis and defining a space between inner sides of the blades; a motor operatively connected to said centrifugal propeller; an air outlet adapted to evenly ventilate and heat a room in which the centrifugal ceiling fan is installed, the air outlet comprising: a first passage at the side for pushing air from the side, and a second passage for pushing air downward, the second passage comprising a dome for regulating an amount of air flow between the first passage and the second passage, the dome defining a volume and being provided underneath the propeller and partially within the space defined by the inner side of the blades; and a coil provided within the volume to heat the air pushed downward.

The blades may be curved along three dimensions and have a variable width such that rotation of the centrifugal propeller causes air to be received from said air inlet and to be pushed from said air outlet in substantially all directions between the first direction and the second direction.

In yet another aspect, there is provided a centrifugal ceiling fan comprising: a casing defining a top, a side and a bottom; an air inlet provided at the top of the casing; a centrifugal propeller configured to rotate about a rotation axis, and configured to push the air in substantially all directions between a first direction parallel to the rotation axis and a second direction perpendicular to the rotation axis; a motor operatively connected to said centrifugal propeller; an air outlet comprising a first passage at the side, and a second passage for pushing air from the bottom; the air outlet comprising a dome for regulating an amount of air flow between the first passage and the second passage to a desired proportion, and a coil adapted to heat the air pushed downward from the bottom, wherein rotation of the centrifugal propeller causes air to be received from said air inlet and to be pushed from said air outlet in substantially all directions between the first direction and the second direction, wherein heated air is pushed downward and unheated air is pushed sideways for evenly ventilating and heating a room in which the centrifugal ceiling fan is installed.

The central dome comprises a plurality of openings which are shaped to direct the flow of air pushed downward to desired directions, and dimensioned to regulate an amount of air flow pushed downward to the desired proportion.

According to an embodiment, there is provided a centrifugal ceiling fan comprising: a casing comprising an air inlet and an air outlet, a centrifugal propeller comprising a rotation shaft and a plurality of blades provided around said shaft, said blades being curved to push the air in substantially all directions between a first direction substantially perpendicular to the rotation shaft and a second direction substantially parallel to the rotation shaft; a motor operatively connected to said centrifugal propeller for rotating said centrifugal propeller; said motor and said centrifugal propeller being provided within said casing; wherein rotation of the centrifugal propeller causes air to be received from said air inlet and to be pushed from said air outlet in substantially all directions between the first direction and the second direction.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

The embodiments describe a centrifugal ceiling fan adapted to evenly ventilate and heat its surrounding area. The fan comprises a casing defining a top, a side, and a bottom. The air inlet is provided in the top and the air outlet comprises a first passage provided in the side and a second passage provided in the bottom. The air outlet comprises a central dome for regulating the flow of air between the first passage and the second passage to a desired proportion. The central dome comprises a plurality of openings shaped and dimensioned to define the amount and the direction of the air flow pushed downward. The fan comprises a centrifugal propeller having blades which are curved and have a variable width such that rotation of the centrifugal propeller causes air to be received from said air inlet and to be pushed from said air outlet in substantially all directions between the first direction and the second direction. A heat source may be provided within the dome for heating air pushed downward from the bottom. Whereby, unheated air is pushed sideways and heated air is pushed downward for evenly ventilating and heating a room in which the centrifugal ceiling fan is installed.

FIGS. 3*a* to 3*d* illustrates different views of an exemplary ceiling fan, in accordance with an embodiment.

Figure 1:
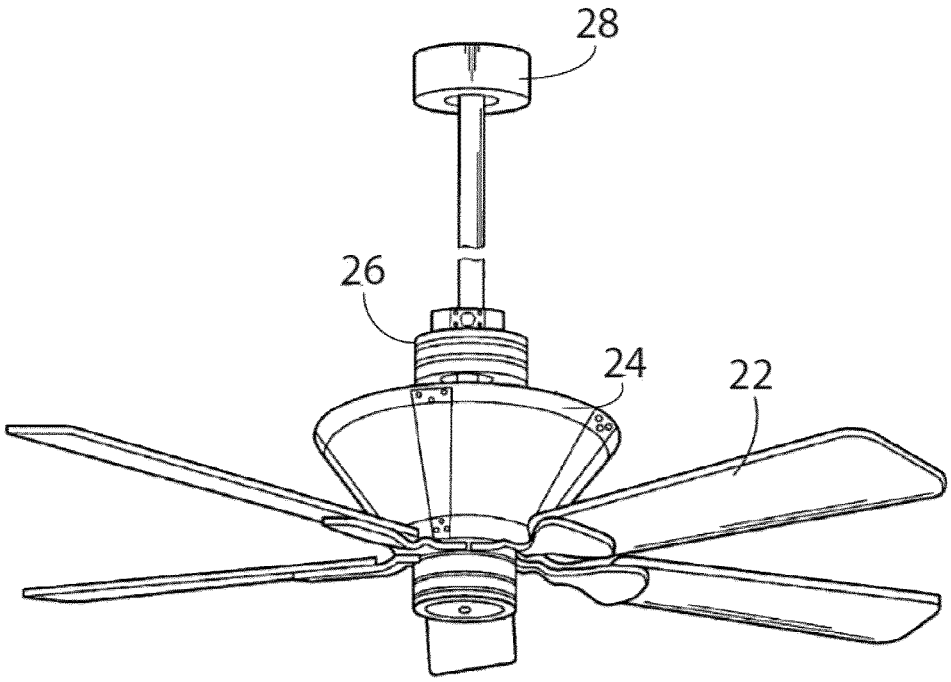
FIG 1 PRIOR ART
FIG. 1 illustrates a conventional axial ceiling fan.
Figure 2:
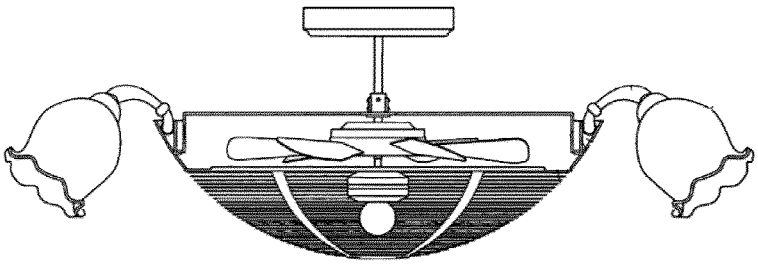
FIG 2 PRIOR ART
FIG. 2 illustrates a conventional axial ceiling fan with a casing.
Figure 3A:
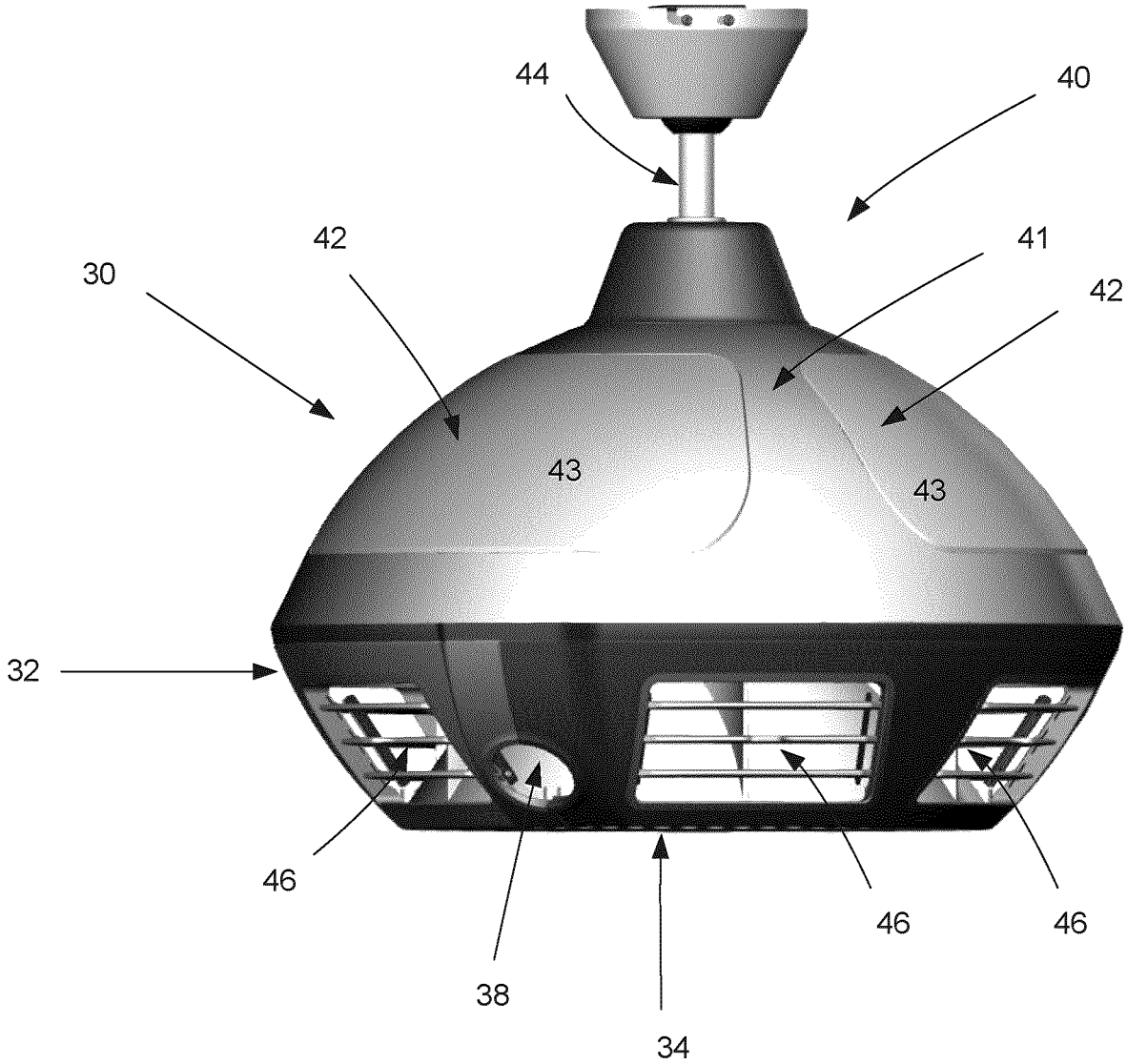
FIGS. 3*a* to 3*c* illustrates different views of an exemplary ceiling fan, in accordance with an embodiment.

As exemplified in FIG. 3*a* the fan 40 comprises a casing 41 having a top 30, a side 32 and a bottom 34 defining the air outlet. In a non-limiting example, and as shown in FIG. 3*a* the top has a shape of an inversed-bowl, the side has the shape of a trapezoid, and the bottom defines a flat surface. The top 30 comprises the air inlet having a plurality of openings 42, and the side 32 and bottom 34 define the air outlet. The air inlet openings 42 may include air filters 43 for filtering dust, pollen, odor particles and other contaminants. The fan 40 may also include an attachment 44 for attaching the fan 40 to the ceiling or an upper structure. In an embodiment, a cable may be provided/passed within the attachment 44 for providing electrical power (and/or a control signal of some sort) from the ceiling for powering the motor, heater, wireless receiver, or other mechanical and electrical structures provided in the fan 40, as will be described in detail herein below.

Figure 3B:
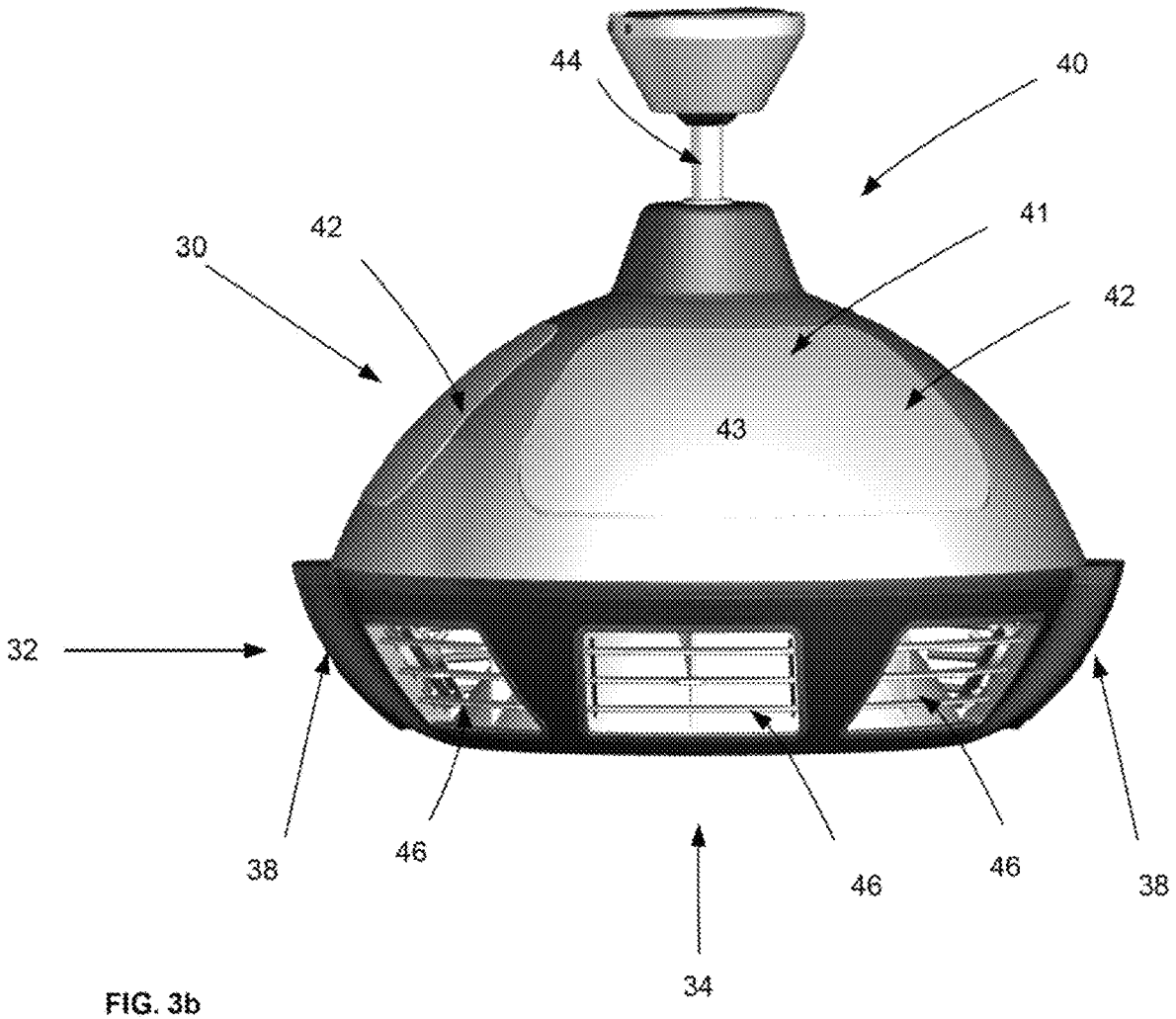

A light source 38 (e.g. a LED light) may be provided in the casing 41 in a suitable location that allows the light to shine downward. In the exemplary design shown in FIG. 3*a*, the light 38 is provided on the side 32. FIG. 3*b* shows the fan of FIG. 3*a* from a different angle and illustrates two lights 38 provided at opposite locations with respect to the circumference of the side 32. In the present example, the lights 38 are provided between two openings of the air outlet at the side 32. It should be noted however that the design is not limited to this configuration, and that other scenarios are possible for mounting the lights on the casing 41.

Figure 3C:
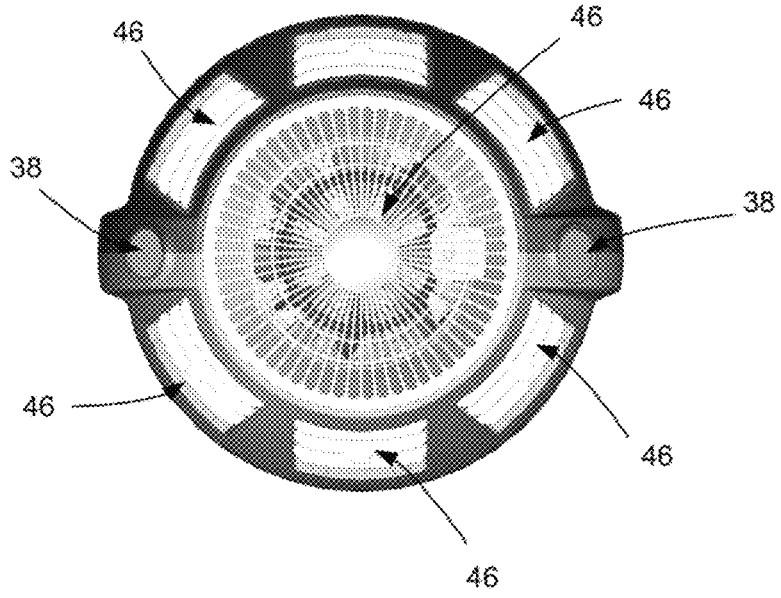
Figure 3D:
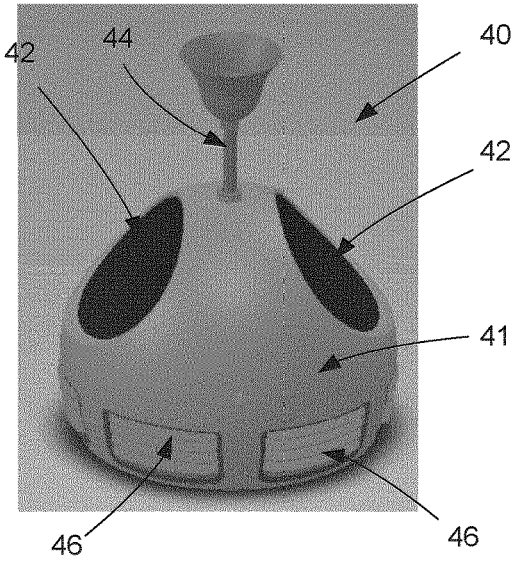
FIGS. 3*d* to 3*f* illustrate different views of another embodiment of a ceiling, in accordance with an embodiment.

FIG. 3*c* is a bottom view of the fan of FIG. 3*a* showing the air outlet provided at the bottom of the fan. The bottom air outlet comprises a grill having openings therein from which the air is pushed downward.

Figure 3E:
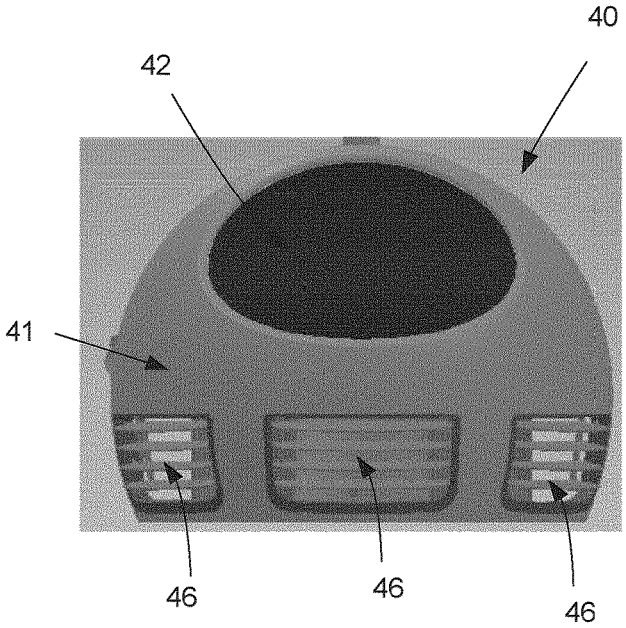
Figure 3F:
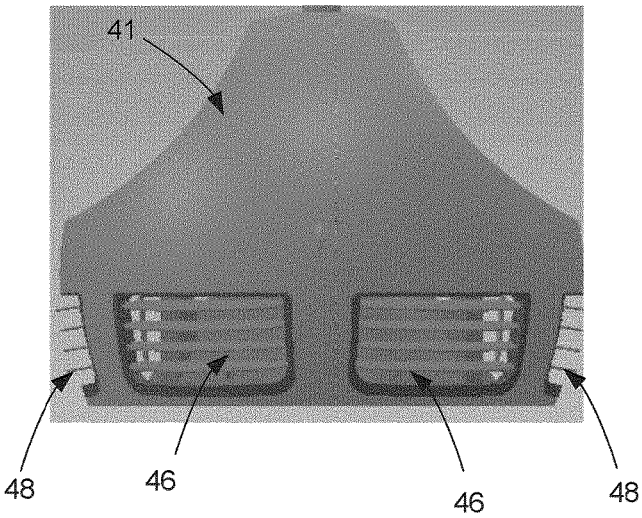

It should be noted that the design is not limited to the shape shown in FIGS. 3*a* & 3*b* nor to the number of filters 43 or lights 38. Other shapes and configurations may be used without departing from the scope of the claims. For example, the fan may take the shape of an inversed-bowl or the like, as exemplified in FIGS. 3*d* to 3*f*.

Referring back to the embodiment of FIGS. 3 to 3*c*, the casing 41 comprises an air outlet comprising a plurality of openings 46 provided at the side and bottom of the fan 40. In an embodiment, the openings at the side 32 may include an air regulator 48 for directing the direction of the air in the desired position by controlling the angle of opening of the blades when needed and depending on ceiling height and room dimensions. The air regulator 48 as well as other functions of the fan 40 such as activation/deactivation and speed of the motor, activation/deactivation and intensity of the light, activation/deactivation and intensity of heat etc., may be controlled from a distance using a wireless remote control or otherwise. In an embodiment, a wireless receiver/transceiver 49 may be provided within the fan 40 for receiving commands from a remote control for controlling the various functions of the fan 40.

Figure 4:
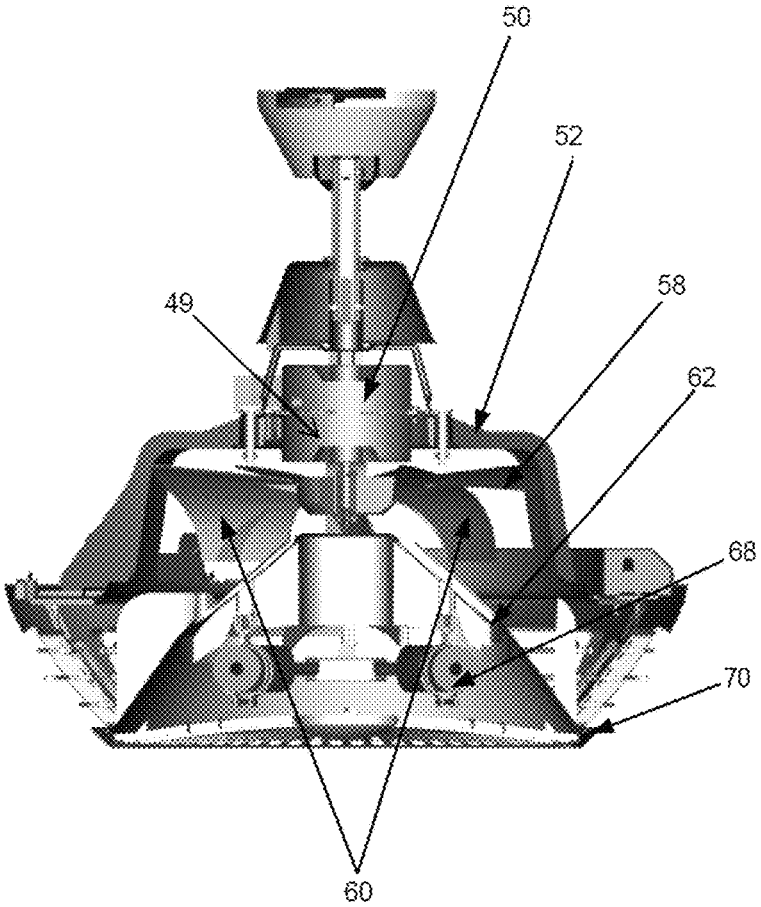
FIG. 4 illustrates a cross-sectional view of an exemplary ceiling fan, in accordance with an embodiment.
Figure 5:
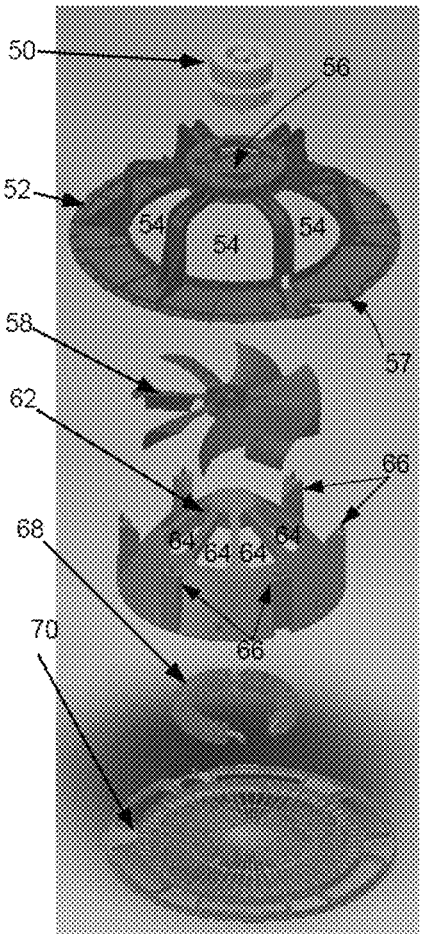
FIG. 5 is an exploded view illustrating the major components of the ceiling fan shown in FIG. 4.

FIG. 4 illustrates a cross-sectional view of an exemplary ceiling fan, in accordance with an embodiment, and FIG. 5 is an exploded view illustrating the major components of the ceiling fan shown in FIG. 4.

Figure 8:
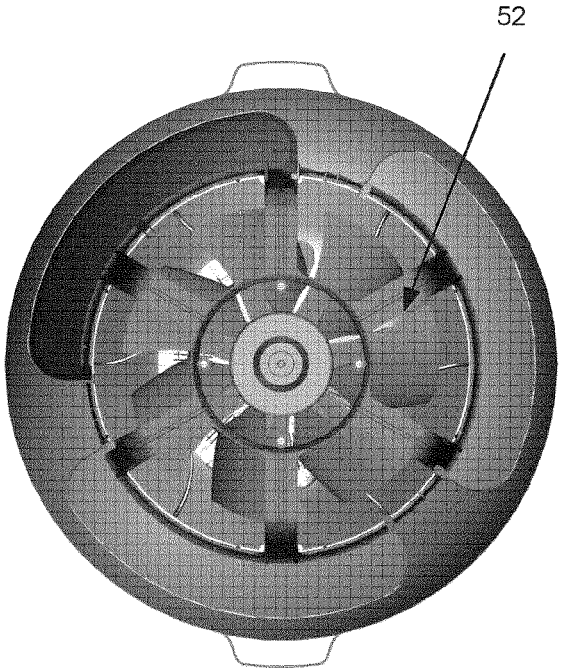
FIG. 8 is a cross-sectional view of the fan along the X-Z plane showing the support from the top.

As shown in FIG. 4, the fan 40 comprises a motor 50 supported by a support 52 (FIG. 8 is a cross-sectional view of the fan along the X-Z plane showing the support from the top). The support 52 defining a plurality of openings 54 for receiving air from outside and an upper structure 56 for receiving the motor 50. The openings 54 and the upper structure 56 are defined by a plurality of ribs extending between the upper structure 56 and the base 57 of the support 52.

Figure 6A:
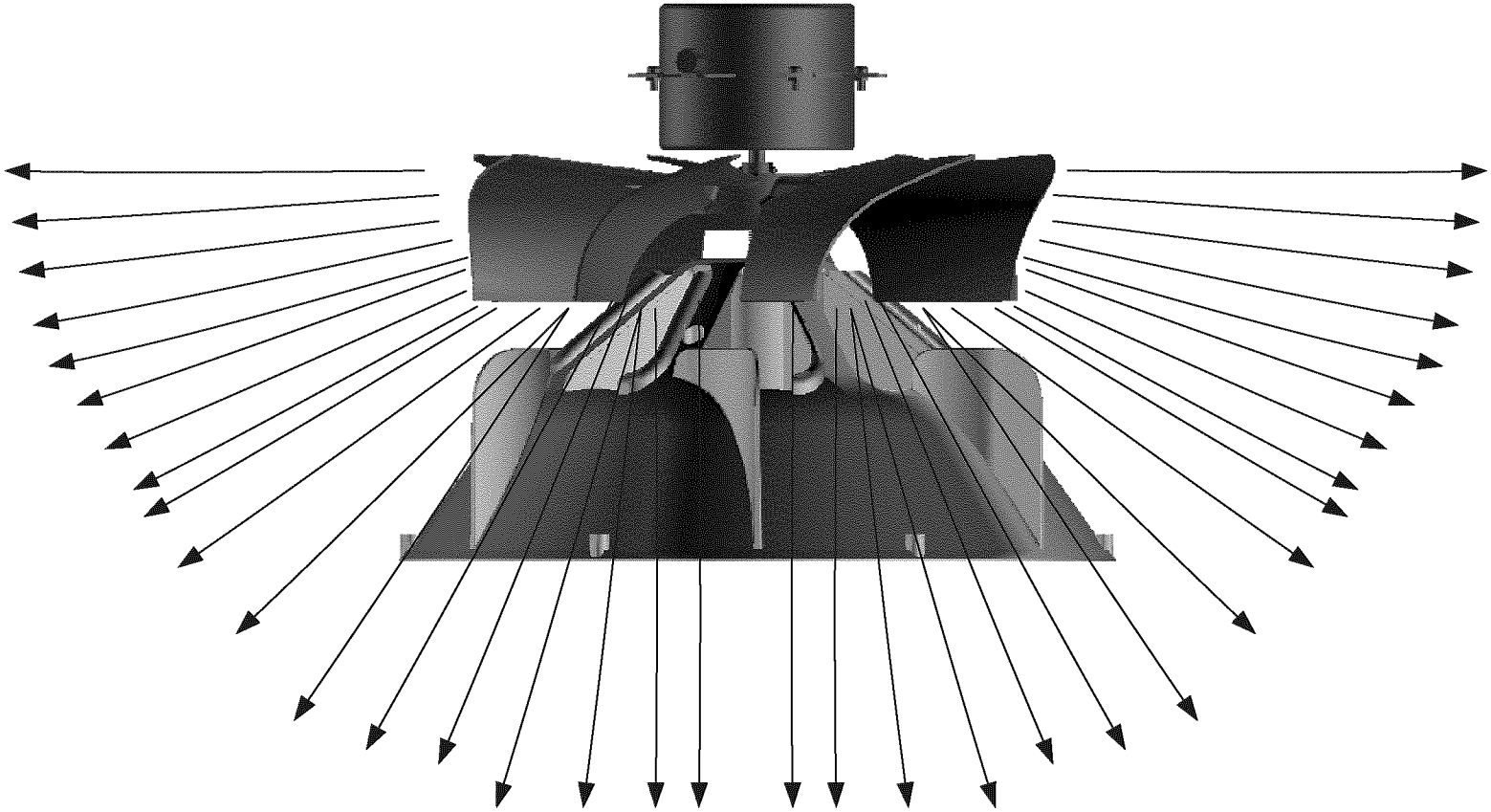
FIG. 6*a* illustrates the flow of air out of the propeller and the central dome when the propeller is rotated.
Figure 9:
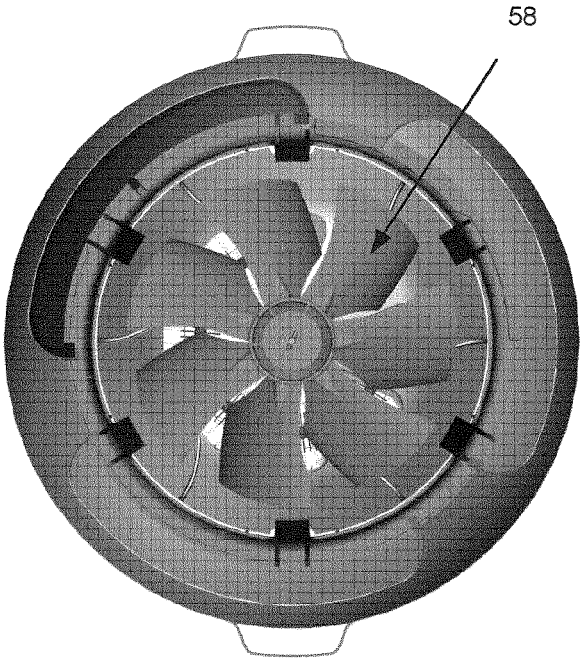
FIG. 9 is a cross-sectional view of the fan along the X-Z plane showing the propeller from the top.

The motor 50 is operably connected to a centrifugal propeller 58 comprising a plurality of blades 60 (FIG. 9 is a cross-sectional view of the fan along the X-Z plane showing the propeller from the top). In an embodiment, the blades 60 are curved along the three dimensions and have a width that varies along the direction of the axis of rotation as clearly illustrated in FIG. 6*a*. FIG. 6*a* illustrates the flow of air out of the propeller and the central dome 62 when the propeller is rotated, such that when the blades 60 rotate, they push the air in substantially all directions between the horizontal axis and the vertical axis (axis of rotation). In an embodiment, the width of the blades 60 decreases toward the lower end of the fan 40 whereby a space is defined between the inner sides of the blades to receive, at least in part, a central dome 62 for regulating the air flow between the side passage and the bottom passage for evenly ventilating the area in which the fan 40 is installed.

Figure 10:
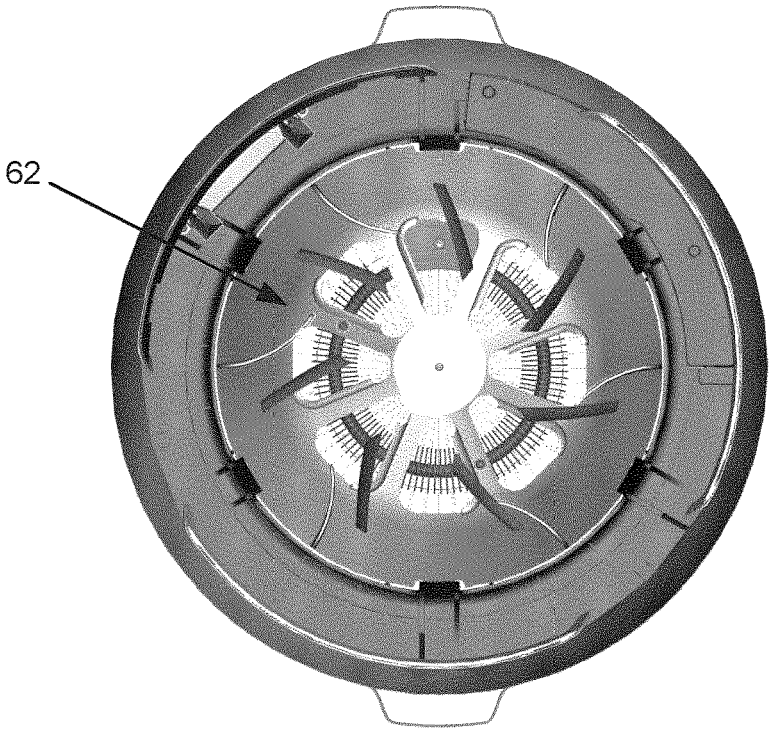
FIG. 10 is a cross-sectional view of the fan along the X-Z plane showing the central dome from the top.

In an embodiment, the central dome 62 houses a heating element e.g. coil 68, for heating the air pushed downward from the bottom passage. As shown in FIGS. 4&5, the central dome 62 may be provided underneath and at least partially within the propeller 58 (FIG. 10 is a cross-sectional view of the fan along the X-Z plane showing the central dome from the top). The central dome 62 comprises a plurality of openings 64 at the top thereof and a plurality of rod shaped elements 66 defining spacing there between. The openings 64 provided in the dome 62 are dimensioned to regulate the flow of air between the side passage and the bottom passage to a desired proportion. e.g. 80/20 or 70/30, for evenly ventilating the room. In an embodiment, the openings 64 are shaped to direct the flow of air pushed downward.

In a non-limiting example, the openings 64 are provided in the shape of triangle like cutouts wherein the opening of each cutout decreases toward the rotation shaft and increases away from it in order to decrease the amount of air pushed downwardly and increase the amount of air pushed angularly. In another embodiment, the size of the openings may vary depending on the width/size of fan such that the wider/bigger the fan the bigger are the openings 64 and vice versa. The rods 66 protrude from the base of the dome perpendicularly to the base of the dome 62 and define the openings through which air is pushed through the side. The rods 66 may be provided under the support 52 and define the height of the air outlet.

Figure 11:
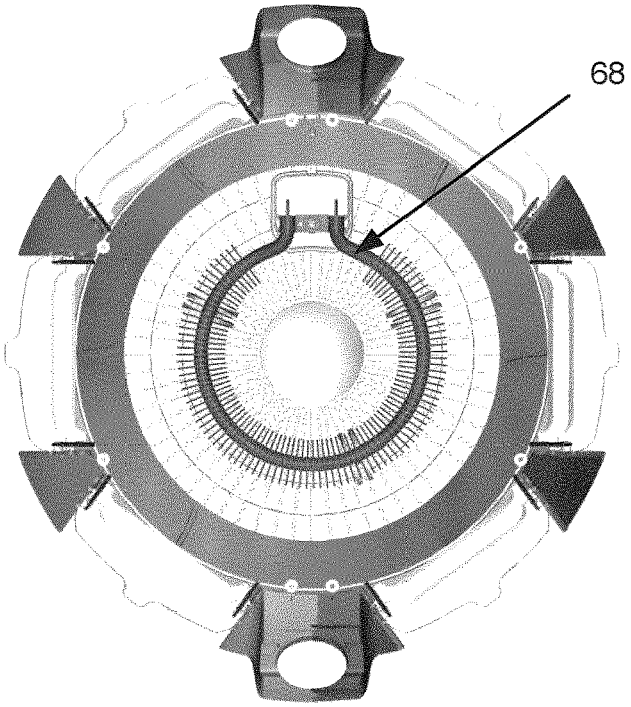
FIG. 11 is a cross-sectional view of the fan along the X-Z plane showing the coil from the top.

In an embodiment, the fan 40 may include a coil 68 shaped and dimensioned to be provided within the inner side of the dome 62 such that the air pushed downward from the propeller 58 through the openings 64 would be heated by the coil 68 while the air pushed through the space define between the rods 66 and through the side openings would not be heated. This configuration is beneficial in distributing the heat evenly in the room in which the ceiling fan is installed. (FIG. 11 is a cross-sectional view of the fan along the X-Z plane showing the coil from the top).

Figure 6B:
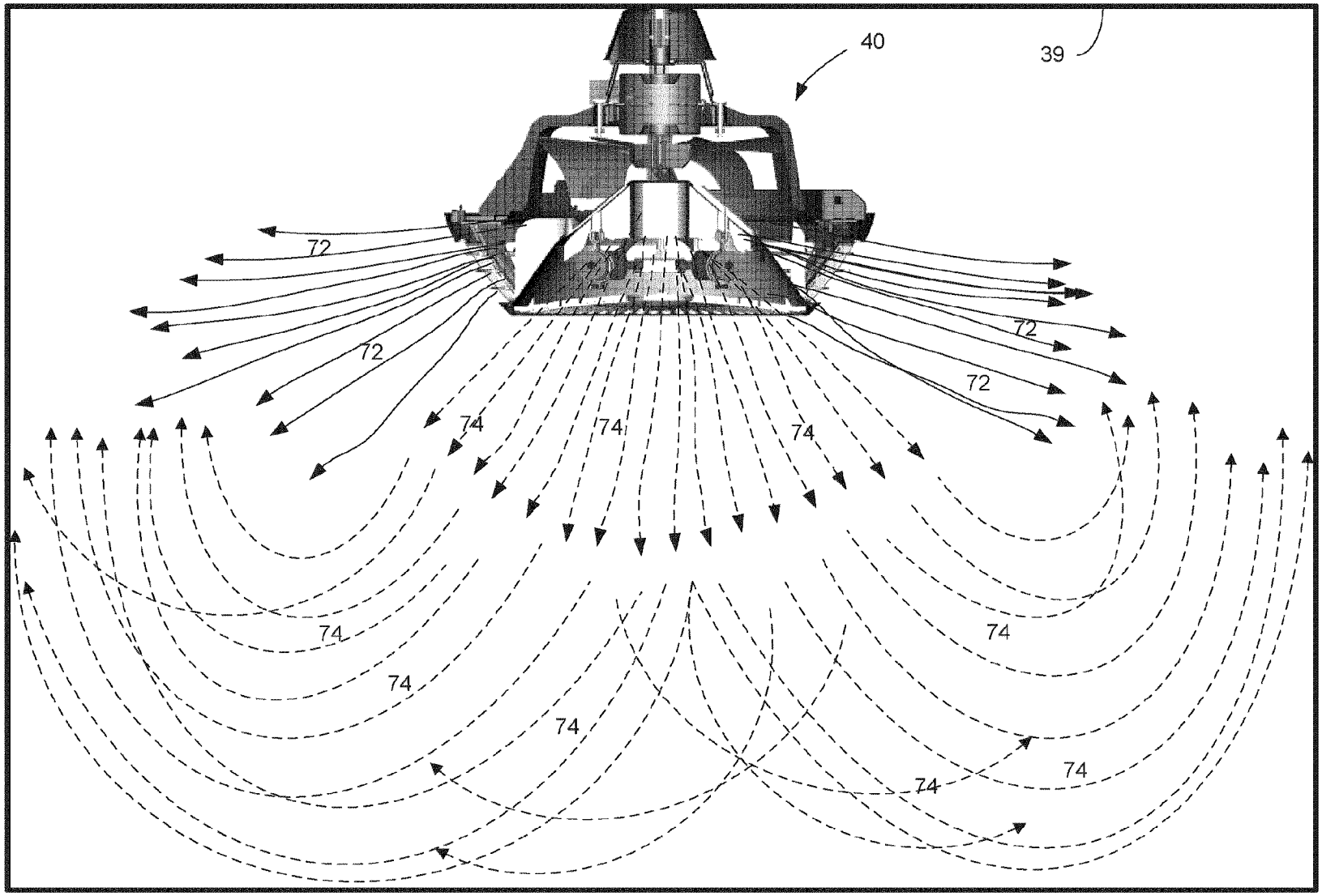
FIG. 6*b* which illustrates the even distribution of heat and air throughout the room wherein heated air flow is shown in dotted lines and unheated air flow is shown in straight lines.
Figure 7:
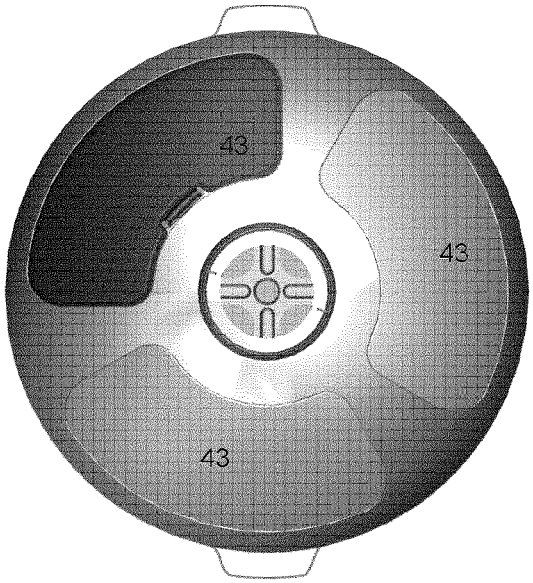
FIG. 7 is a cross-sectional view of the fan along the X-Z plane showing the air inlet from the top.

This concept is illustrated in FIG. 6*b* which illustrates the even distribution of heat and air throughout a room 39 using a fan 40 in accordance with an embodiment. In FIG. 6*b*, heated air flow 74 is shown in dotted lines and unheated air flow 72 is shown in straight lines. As shown in FIG. 6*b*, since the heated air 72 is lighter than the unheated air, it tends to rise up when pushed downward. Thereby, heated air 72 exiting the central dome 62 from the bottom 34 of the fan 40 spreads evenly throughout the room and raises up to heating and ventilating the room more evenly. By contrast, if the air 72 exiting fan horizontally from the side 32 is also heated, it would tend to accumulate near the ceiling rather than spreading within the room.

The fan 40 is adapted and configured to push the heated air downward through the air outlet 46 provided at the bottom portion/grill 70. The heated air is pushed downward perpendicularly and at a slight angle e.g. about 45° as exemplified in arrows 74 in FIG. 6*b* while the unheated air is pushed sideways as indicated by arrows 72 such that the combination of both airflows would ensure even ventilation and heat distribution in the room. Needless to say, if the coil is not activated (or not present) the room would still be evenly ventilated and air is pushed out of the fan 40 in all directions as exemplified in FIGS. 6*a* and 6*b*.

FIGS. 4 and 5 also show a bottom grill 70 defining the bottom 32 of the fan 40. The grill 70 comprises a plurality of openings there through from which the air pushed downward would exit.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A centrifugal ceiling fan comprising:

a casing defining a top, a side and a bottom;

an air inlet provided at the top of the casing;

a centrifugal propeller configured to rotate about a rotation axis;

a motor operatively connected to said centrifugal propeller;

an air outlet comprising a first passage for pushing air from the side, and a second passage for pushing air from the bottom; the air outlet comprising a central dome, the central dome being adapted to distribute a flow of air between the first passage and the second passage to a desired proportion; and a coil in a portion of the central dome in contact only with the air pushed downward through the second passage, to heat only the air pushed downward, and distant from the air flowing through the first passage such that the air flowing through the first passage is unheated, wherein rotation of the centrifugal propeller causes air to be received from said air inlet and to be pushed from said air outlet in all directions which are downward and sideways for evenly ventilating a room in which the centrifugal ceiling fan is installed.

2. The centrifugal ceiling fan of claim 1, wherein the central dome comprises a plurality of openings which are shaped to direct the flow of air pushed downward to desired directions, and dimensioned to regulate an amount of air flow pushed downward to the desired proportion.

3. The centrifugal ceiling fan of claim 1, wherein the propeller comprises a plurality of blades provided about the rotation axis, the blades being curved along three dimensions and have a width that varies along the rotation axis to define a space between inner sides of the blades.

4. The centrifugal ceiling fan of claim 3, wherein the central dome is provided under the propeller and at least partially received within the space defined by the inner side of the blades.

5. The centrifugal ceiling fan of claim 1, wherein the central dome comprises a heating element for heating air pushed downward.

6. The centrifugal ceiling fan of claim 1, further comprising an air regulator for regulating the flow of air exiting the fan from the side.

7. The centrifugal ceiling fan of claim 1, further comprising an air filter provided at the air inlet.

8. The centrifugal ceiling fan of claim 1, further comprising a light source.

9. A centrifugal ceiling fan comprising:

a casing defining a top, a side and a bottom;

an air inlet provided at the top of the casing;

a centrifugal propeller comprising a plurality of blades provided about the rotation axis and defining a space between inner sides of the blades;

a motor operatively connected to said centrifugal propeller;

an air outlet comprising:

a first passage for pushing air from the side, and a second passage for pushing air downward from the bottom;

a central dome for regulating air flow between the first passage and the second passage to a desired proportion, the central dome defining a volume and being provided underneath the propeller and partially within the space defined by the inner side of the blades; and a coil provided within the portion of the central dome in contact only with the air pushed downward from the bottom through the second passage to heat only the air pushed downward, and distant from the air flowing through the first passage such that the air flowing through the first passage is unheated;

wherein rotation of the centrifugal propeller causes air to be received from said air inlet and to be pushed from said air outlet in all directions which are downward and sideways, wherein heated air is pushed downward from the bottom and unheated air is pushed sideways for evenly ventilating and heating a room in which the centrifugal ceiling fan is installed.

10. The centrifugal ceiling fan of claim 9, wherein the central dome comprises a plurality of openings which are shaped to direct the flow of air pushed downward to desired directions, and dimensioned to regulate an amount of air flow pushed downward to the desired proportion.

11. The centrifugal ceiling fan of claim 9, wherein the blades are curved along three dimensions and have a width that varies along the rotation axis.

12. The centrifugal ceiling fan of claim 9, further comprising an air regulator for regulating the flow of air exiting the fan from the side.

13. The centrifugal ceiling fan of claim 9, further comprising an air filter provided at the air inlet.

14. The centrifugal ceiling fan of claim 9, further comprising a wireless receiver for receiving operation commands from a remote control for controlling operation of the fan.

15. The centrifugal ceiling fan of claim 9, wherein the top has a shape of an inversed-bowl, the side has the shape of a trapezoid, and the bottom defines a flat surface.

16. A centrifugal ceiling fan comprising:

a casing defining a top, a side and a bottom;

an air inlet provided at the top of the casing;

a centrifugal propeller comprising a plurality of blades provided about the rotation axis and defining a space between inner sides of the blades;

a motor operatively connected to said centrifugal propeller;

an air outlet adapted to evenly ventilate and heat a room in which the centrifugal ceiling fan is installed, the air outlet comprising:

a first passage at the side for pushing air from the side, and a second passage for pushing air downward, the second passage comprising a dome for regulating an amount of air flow between the first passage and the second passage, the dome defining a volume and being provided underneath the propeller and partially within the space defined by the inner side of the blades; and a coil provided within the volume of the dome in contact only with the air pushed downward through the second passage to heat only the air pushed downward, and distant from the air flowing through the first passage such that the air flowing through the first passage is unheated.

17. The centrifugal ceiling fan of claim 16, wherein the blades are curved along three dimensions and have a variable width such that rotation of the centrifugal propeller causes air to be received from said air inlet and to be pushed from said air outlet in all directions which are downward and sideways.

18. A centrifugal ceiling fan comprising:

a casing defining a top, a side and a bottom;

an air inlet provided at the top of the casing;

a centrifugal propeller configured to rotate about a rotation axis, and configured to push the air in substantially all directions between a first direction parallel to the rotation axis and a second direction perpendicular to the rotation axis;

a motor operatively connected to said centrifugal propeller;

an air outlet comprising a first passage at the side, and a second passage for pushing air from the bottom; the air outlet comprising a dome for regulating an amount of air flow between the first passage and the second passage to a desired proportion, and a coil in a portion of the central dome in contact only with the air pushed downward through the second passage to heat only the air pushed downward, and distant from the air flowing through the first passage such that the air flowing through the first passage is unheated, wherein rotation of the centrifugal propeller causes air to be received from said air inlet and to be pushed from said air outlet in all directions which are downward and sideways, wherein heated air is pushed downward and unheated air is pushed sideways for evenly ventilating and heating a room in which the centrifugal ceiling fan is installed.

19. The centrifugal ceiling fan of claim 18, wherein the central dome comprises a plurality of openings which are shaped to direct the flow of air pushed downward to desired directions, and dimensioned to regulate an amount of air flow pushed downward to the desired proportion.

20. The centrifugal ceiling fan of claim 18, wherein the propeller comprises a plurality of blades provided about the rotation axis, the blades being curved along three dimensions and have a width that varies along the rotation axis to define a space between inner sides of the blades.

21. The centrifugal ceiling fan of claim 18, wherein the top has a shape of an inversed-bowl, the side has the shape of a trapezoid, and the bottom defines a flat surface.

* * * * *